United States Patent [19]

Morita

[11] 4,302,864

[45] Dec. 1, 1981

[54] COMBINATION DOOR STOP AND LATCHING DEVICE

[76] Inventor: Mike Y. Morita, 15722 S. Normandie Ave., Gardena, Calif. 90247

[21] Appl. No.: 94,701

[22] Filed: Nov. 16, 1979

[51] Int. Cl.[3] ..... E05F 5/06

[52] U.S. Cl. ..... 16/85

[58] Field of Search ..... 16/85, 82; 403/321; 292/99, 130, 131, 136, 198, 230, DIG. 4, DIG. 19, 127

[56] References Cited

U.S. PATENT DOCUMENTS 2,496,691 2/1950 Berry ..... 16/85 X 4,159,837 7/1979 Morita ..... 292/DIG. 19

*Primary Examiner*—Wayne L. Shedd

*Attorney, Agent, or Firm*—Francis X. LoJacono

[57] ABSTRACT

The combination door stop and releasable latching device, which includes a keeper member generally mounted to a conventional door and positioned thereon to engage a stationary door stop having a latching mechanism coupled therewith, wherein the door stop comprises a main supporting body which is mounted in a fixed location relative to the keeper member for locking engagement therewith, the fixed body having a slidable bumper cover which is spring-biased in an outward direction for operational engagement with the keeper member, and wherein a free-falling latching lever is pivotally mounted to the fixed body and arranged to be actuated to an open mode by a cam-pin actuator secured to the bumper cover and releasably latchable over the head of the keeper when the door is positioned in an open mode.

2 Claims, 12 Drawing Figures

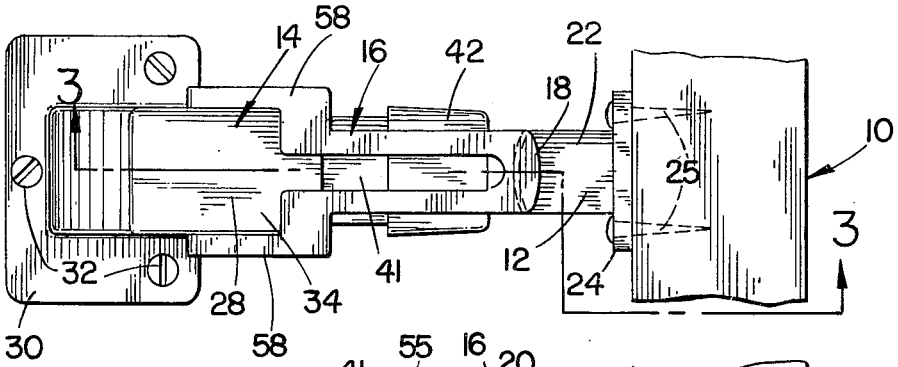
FIG. 2
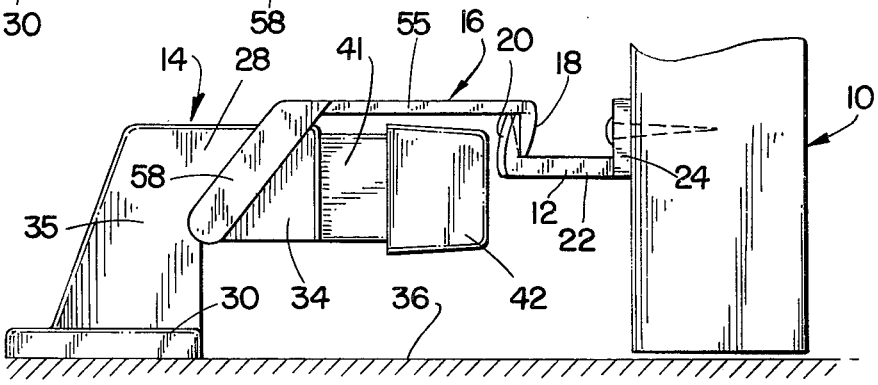
FIG. 1
FIG. 5
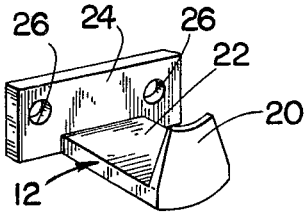
FIG. 3
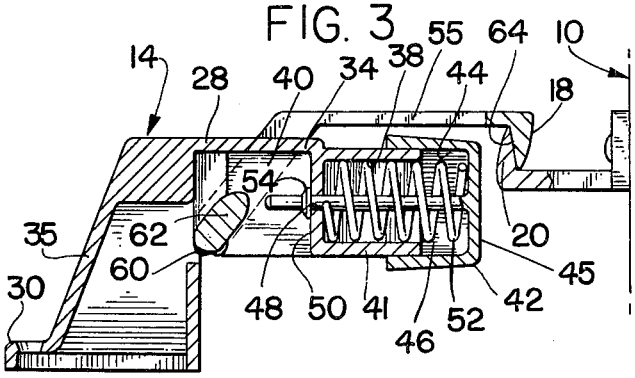
FIG. 6
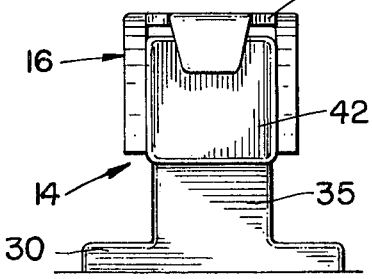
FIG. 4
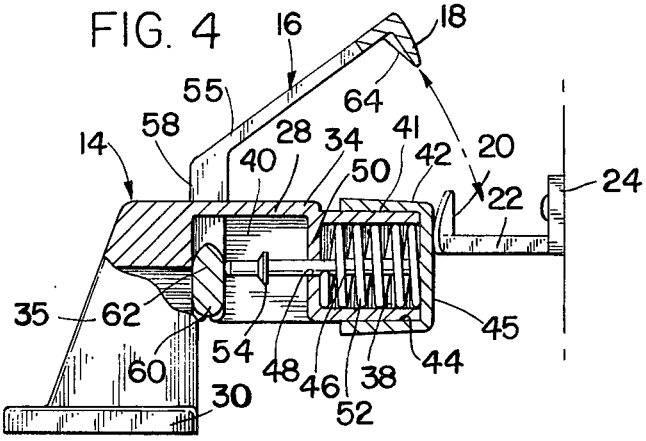
FIG. 7
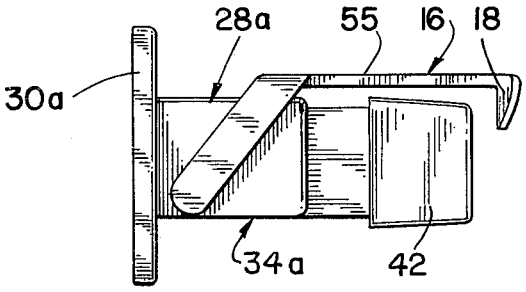

FIG. 8
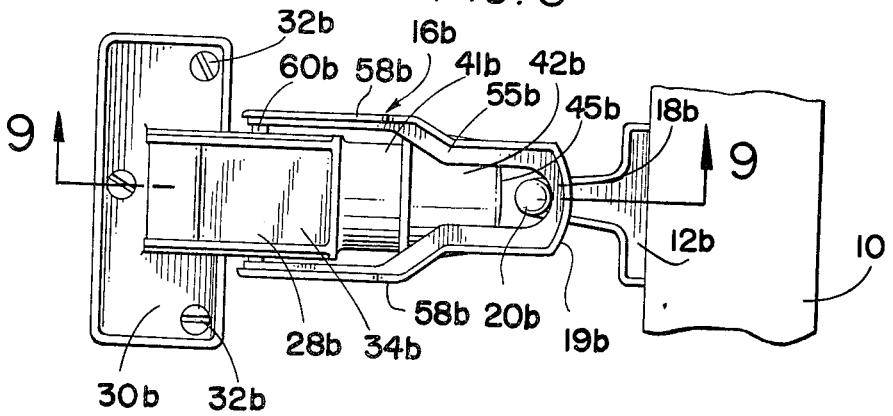
FIG. 9
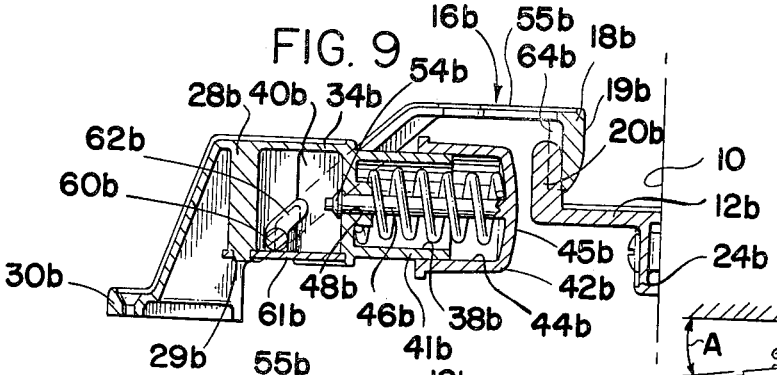
FIG. 13
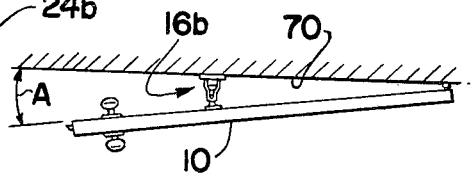
FIG. 10
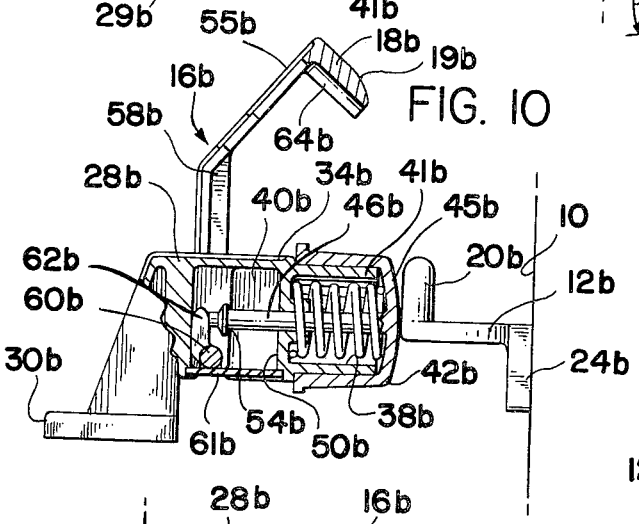
FIG. 12
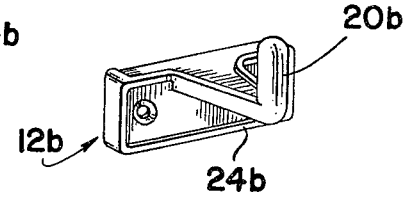
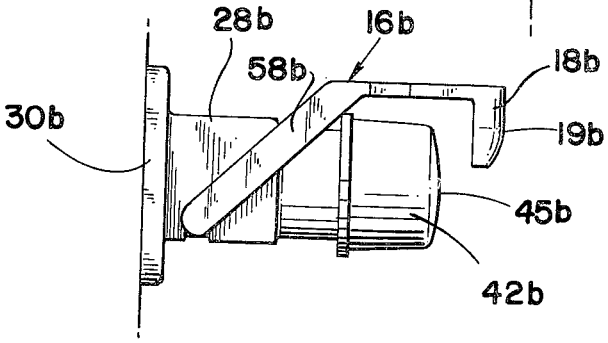
FIG. 11

COMBINATION DOOR STOP AND LATCHING DEVICE

BACKGROUND OF THE INVENTION

1. Field of the Invention

This invention relates generally to a door stop and more particularly to a door stop having an associated spring biased, releasable-latching mechanism.

2. Description of the Prior Art

Various problems and difficulties are encountered in providing suitable means to prevent doors from opening too wide and abutting against the adjacent walls, and at the same time providing a device that can be employed as a latching device to hold the door in an open position.

Several types of door stops have been tried and used, and some of these also include self-latching devices in combination therewith. However, the known devices have features that restrict their use and placement with respect to the doors and surrounding areas. Further, most known devices are too complicated to operate and/or are too expensive to install and maintain, especially when a building would require large amounts of hardware for such a purpose.

Many doors are provided with self-closing devices that are not compatible with known door-stop and latching mechanisms.

As examples of the various devices that are known in the art, one may refer to the following U.S. Pat. Nos.: 905,804; 1,309,310; 1,896,363; 1,694,023; and 1,126,836.

One answer to the above problems of the prior art is presented in the pending application Ser. No. 928,721 which is about to issue to the present applicant, this application being an improvement thereover for operational and constructive simplicity.

SUMMARY OF THE INVENTION

The present invention comprises a door stop that includes an automatic self-releasing latching mechanism, whereby a door can be opened to its fullest open position and be releasably secured in the open position by a latching-keeper member and door stop provided with a latching mechanism, the keeper being mounted to the door with the door stop being mounted to the adjacent wall or floor so as to be engageably disposed and aligned to each other.

The door stop includes a spring-biased, slidable, bumper member which—when engaged by the keeper member—allows a latching lever of the latching mechanism to arcuately rise above the door-stop body so as to release the keeper from the latching lever.

A latching tongue formed on the latching lever is so arranged as to be engageable with the keeper member, to allow the tongue to latch behind the head of the keeper member for the purpose of holding the associated door in an open position.

However, by simply forcing the door against the bumper, the latching lever will automatically be raised to permit the keeper to separate therefrom, allowing the door to again close.

OBJECTS AND ADVANTAGES OF THE INVENTION

The present invention has for an important object a provision wherein a door can be latched in an open position, and released from the open position back to a closed position, merely by movement of the door, the present device being designed to become automatically latched or unlatched by means of a keeper mounted to the door.

It is another object of the invention to provide one embodiment that will be mounted to a fixed wall, and a second embodiment that is adapted to be mounted on the floor and positioned thereon to engage a keeper mounted to the door.

It is still another object of the invention to provide a combination door stop and latching device that includes relatively few operating parts.

It is a further object of the invention to provide a combination door stop and latching device that is relatively inexpensive to manufacture.

It is still a further object of the present invention to provide a device of this character that is simple yet strong in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a side-elevational view of the present invention showing the door stop mounted to the floor, and the keeper member secured to the door and latched to the door stop;

FIG. 2 is a top plan view thereof;

FIG. 3 is a cross-sectional view taken substantially along line 3—3 of FIG. 2, showing the latched mode thereof;

FIG. 4 is a cross-sectional view similar to that of FIG. 3, wherein the latch is in an unlocked mode;

FIG. 5 is a perspective view of the keeper member;

FIG. 6 is a front-elevational view of the door stop mechanism;

FIG. 7 is a side-elevational view of an alternative arrangement of the door-stop mechanism designed to be mounted to a wall;

FIG. 8 is a top-plan view of an alternative arrangement of the floor-mounted device;

FIG. 9 is a cross-sectional view taken substantially along line 9—9 of FIG. 8, showing the alternative arrangement of the latching lever and keeper member;

FIG. 10 is a cross-sectional view similar to FIG. 9, wherein the latching lever is shown disengaged from the keeper member;

FIG. 11 is a side-elevational view of the door-stop mechanism designed to be mounted to a wall structure;

FIG. 12 is a perspective view of one embodiment of the keeper member having an annular leading head member; and FIG. 13 is a top-plan schematic view of a door locked in an open mode when the wall mounted door stoop is used.

DESCRIPTION OF THE PREFERRED EMBODIMENT

Referring more particularly to FIG. 1, there is shown a door 10, whereon there is mounted a keeper member 12 which is positioned to engage the door-stop device, generally indicated at 14. A latching mechanism, designated at 16, is shown as being included as a member of the door stop having an enlarged latching tongue member 18 engaging an opposing head member 20 of keeper 12.

Accordingly, the keeper member 12 comprises the enlarged leading head member 20 formed on the free end of the outwardly extending arm member 22 which is further provided with a rear-mounting plate 24, as seen in FIG. 5. The rear-mounting plate is adapted to be secured to door 10 in any suitable conventional manner such as by screws 25 that are received through a pair of openings 26.

The door-stop device comprises a main body 28 having a mounting means defined by a plate 30 integrally formed at the lower rear portion of the main body 28, wherein plate 30 includes a plurality of holes through which screws 32 are received.

In the embodiment as seen in FIGS. 1 through 4, the main body 28 is defined by a horizontally disposed housing 34 and a rearwardly depending support base 35 on which is formed plate 30, whereby this designed embodiment is secured to a floor structure 36 so as to be in abutting and engaging alignment with keeper 12 mounted to door 10. Housing 34 also defines a first compartment or bore 38 and a second adjacent compartment 40. Bore 38 can be formed cross-sectionally, either as a square or a circular tubular sleeve member 41 adapted slidably receive thereon a bumper cover 42. Bumper cover 42 would, therefore include a bore 44 of the same configuration as tubular member 41 so as to be readily received thereover, as shown in FIG. 3. Cover 42 is provided with a closed-end bumper wall 45 which is adapted to engage head 20 and further provide an inwardly extending longitudinal cam-pin actuator 46 which projects inwardly of bore 38 and passes through hole 48 disposed in partition 50, said actuator extending further into compartment 40, as illustrated in FIGS. 3 and 4.

Thus, it can be seen that bores 38 and 40 are arranged to receive a biasing means defined by a coil spring 52 which forceably reacts against partition 50 and opposing bumper wall 45, whereby cover 42 is generally fully extended outwardly. However, the extended position is determined by stop means 54 affixed adjacent the free end of cam pin 46, the stop means being herein shown as a fixed annular washer.

Referring now to the latching mechanism 16, said latching mechanism comprises a latching lever 55 which includes latching tongue 18 formed at the leading end thereof having a pair of bifurcated side arms 58, wherein the rearward ends thereof are pivotally connected to the rearward portion of housing 34. That is, the bifurcated side arms 58 are provided with a laterally extended shaft 60 which is rotatably supported through compartment 40, whereby arms 58 together with tongue 18 can rotate about an arc, as indicated in FIG.. 4. Shaft 60 is also formed with a centrally disposed cam-abutment member 62 which is positioned within compartment 40 so as to be engaged by cam pin 46 when cover 42 is forceably moved by head 20 of keeper 12.

Accordingly, as door 10 is opened, the outer arcuate surface of head 20 of keeper 12 engages to similar arcuate front surface of latching lever 55 over head 20. Tongue 18 then drops behind head 20, as seen in FIGS. 1 and 3. It should be noted that latching tongue 18 is formed having an inner concaved surface 64, and the inner surface of head 20 is convexed—thereby providing a positive engagement therebetween and locking door 10 in an open mode.

At the time door 10 is to be released, said door is moved so that head 20 engages bumper wall 45 of cover 42, thus moving bumper cover 42 inwardly along tubular member 41 against the force of spring 52, as seen in FIG. 4. Actuator pin 46 moves rearwardly, thus engaging cam-abutment member 62 and causing latching lever to rotate with shaft 60 in an upward rotation. This then frees latching tongue 18 from keeper head 20, allowing door 10 to close and head 20 to disengage from bumper 45 before lever 55 returns to a normal horizontal position, which is effected by spring 52, thus forcing bumper cover 42 back to a fully extended position whereby stop washer 54 rests against partition 50.

FIG. 7 illustrates the above-described device wherein an alternative arrangement of body **28*a* has been made. That is, body 28*a* does not include a depending support base as previously described. This embodiment is designed to be affixed to a vertical wall or partition wherein the mounting plate 30*a* is integrally formed with housing 34*a*. However, latching mechanism 16 is the same as hereinbefore described having latching lever 55 and bumper cover 42**.

Referring to FIGS. 8 through 13, there are shown two additional alternative embodiments which basically function as in the above description for FIGS. 1 through 7. That is, the door-stop mechanism, as shown in FIGS. 8 through 11, comprises a main body member **28*b* on which latching member 16*b* is rotatably mounted. In the arrangement illustrated in FIGS. 8, 9 and 10, body member 28*b* has a lower rear portion on which mounting plate 30*b* is integrally formed, said plate being so positioned as to be secured to a floor structure by suitable screws 32*b*. Thus, main body 28*b* is defined by a horizontally disposed housing 34*b* having a rearwardly depending support base 35*b* on which plate 30*b*** is provided.

Housing **34*b* is provided with an extending cylindrical sleeve member 41*b* having a bore 38*b*. Sleeve 41*b* is adapted to slidably receive thereon a bumper cover 42*b*, the bumper cover 42*b* having a cylindrical bore 44*b* of the same configuration as sleeve 41*b* so as to be readily received thereover, as shown in FIGS. 9 and 10. Cover 42*b* is provided with a closed-end bumper wall 45*b*, the wall having a convexed dome configuration on which an inwardly projecting longitudinal cam-pin actuator 46*b* is integrally formed. Actuator 46*b* extends within a secondary compartment 40*b* defined by partition 50*b* which is disposed between the first and second compartments 38*b* and 40*b*, respectively, whereby actuator 46*b* passes through hole 48*b* formed in partition 50*b*, and is slidably mounted thereto by stop means 54*b***.

Positioned with bores **38*b* and 40*b* is a biasing spring 52*b* which forceably reacts between partition 50*b* and bumper wall 45*b*, cover 42*b* being normally in an extended position as seen in FIG. 9. The extended position of cover 42*b* is determined by the location of stop means 54*b***, shown as a fixed washer.

Latching mechanism **16*b* comprises a latching lever 55*b* which is provided with tongue 18*b*, located at the leading end thereof, having a pair of bifurcated side arms 58*b*—whereby the rearward ends thereof are pivotally mounted to the rearward portion of housing 34*b*. That is, bifurcated side arms 58*b* are integrally connected to each other by a laterally positioned shaft 60*b* which is rotatably mounted through compartment 40*b*, thus allowing arms 58b together with tongue 18b to rotate about an arc. Formed on shaft 60b is a centrally disposed cam-abutment member 62b which is located within compartment 40b so that it will be engaged by cam pin 46b when cover 42 is forceably moved inwardly against spring 52b, as seen in FIG. 10. Shaft 60b is held in place by a bottom plate 61b which is secured to housing 28b at 29b**.

Accordingly, there is provided a keeper member 12 which is secured to door 10 by mounting plate 24b, whereby a rounded cylindrical head member 20b of keeper 12b is positioned to engage the arcuate-faced surface 19b of tongue 18b. That is, as door 10 is opened to contact the door stop, head 20b of keeper 12b engages arcuate surface 19b, at which time latch lever 55b is raised over head 20b—thus allowing head 20b to be locked behind tongue 18b against the inner concaved surface of tongue 18b. This position is shown in FIG. 9.

It is very important to note the configuration of both tongue 18b, with its outer arcuate surface 19b, and the cylindrical arrangement of head 20b. With the combination of the two elements, head 20b is capable of engaging and locking with tongue 18b, regardless of the angle of engagement therebetween. An as example, FIG. 13 shows latching mechanism 16b of the wall support type illustrated in FIG. 11 as being mounted to wall structure 70, with keeper 12b secured to door 10. Depending upon the arrangement between wall 70 and door 10, angle "A" will vary—and so will the engagement angle of latch 16b and keeper 12b. With the indicated configuration of tongue 18b and head 20b, head 20b will readily engage and lift latch 16b at any angle of engagement of head 20b with arcuate surface 19b, and will further lock at any angle when head 20b is positioned within the inner concaved surface 64b.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. In combination, a door stop and latching device to releasably latch a door in an open position, wherein the device comprises:

a main body adapted to be mounted to a fixed structure and having first and second compartments;

an elongated sleeve member having an opened end bore disposed at the forward end of said body, defining said first compartment;

a partition disposed intermediate said first and second compartment, and including a central opening therein;

a latching lever having a latch tongue formed on the free end thereof, said latching tongue having an outer convex, arcuate, engaging surface and an inner concave locking surface, said lever being rotatably mounted to said body;

a shaft mounted to said latching lever whereby said latching lever rotates therewith, said shaft being transversely positioned in said second compartment;

a cam-abutment member affixed to said shaft;

a bumper cover adapted to be slidably mounted on said sleeve member and arranged to cover said bore opening;

a biasing spring disposed in said bore and interposed between said bumper cover and said partition;

an elongated cam-pin actuator attached to said bumper cover disposed longitudinally within said body and positioned to engage said cam-abutment member to cause said latching lever to rotate with respect to said body;

stop means mounted to said cam-pin actuator to limit the forward movement of said bumper cover;

means for securing said body in a fixed position to a stationary structure; and keeper means affixed to said door for engagement with said latching lever and said bumper cover; wherein said keeper means comprises a mounting-plate member, an arm member extending outwardly from said mounting plate, and an enlarged, rounded, cylindrical head member formed on said arm member at right angles thereto and adapted to lockingly engage said inner concave locking surface of said latching tongue, regardless of the angle of incidence therebetween, when said door is positioned in a locked open mode; and means for securing said body in a fixed position to a stationary structure.

2. The combination as recited in claim 7, wherein said bumper cover includes a convexed surface wall for angular engagement with said cylindrical head.

* * * * *